United States Patent [19]

Tupper

[11] 4,238,863

[45] Dec. 16, 1980

[54] METHOD OF WASHING ARTICLES OF CLOTHING

[75] Inventor: Earl S. Tupper, Nassau, The Bahamas

[73] Assignee: TUP! (Panama) S.A., Panama City, Panama

[21] Appl. No.: 910,036

[22] Filed: May 26, 1978

Related U.S. Application Data

[63] Continuation of Ser. No. 634,555, Nov. 24, 1975, abandoned, which is a continuation of Ser. No. 260,250, Jun. 6, 1972, abandoned.

[30] Foreign Application Priority Data

Jun. 8, 1971 [GB] United Kingdom ..... 19750/71
Jul. 30, 1971 [GB] United Kingdom ..... 36067/71

[51] Int. Cl.[3] ..... D06F 1/00; D06F 1/10; D06F 51/00

[52] U.S. Cl. ..... 8/150; 68/213

[58] Field of Search ..... 68/213; 8/150; 100/211

[56] References Cited

U.S. PATENT DOCUMENTS

| | | | |
|---|---|---|---|
| 2,135,780 | 11/1938 | Murray | 68/213 |
| 2,410,323 | 10/1946 | Wellman | 68/213 |
| 3,074,263 | 1/1963 | Farmer | 68/213 |

FOREIGN PATENT DOCUMENTS

| | | | |
|---|---|---|---|
| 182095 | 5/1955 | Austria | 68/213 |
| 539690 | 7/1955 | Belgium | 68/213 |
| 525505 | 5/1956 | Canada | 68/213 |
| 1260342 | 3/1961 | France | 68/213 |
| 528075 | 6/1955 | Italy | 100/211 |

*Primary Examiner*—Philip R. Coe
*Attorney, Agent, or Firm*—Pollock, Vande Sande & Priddy

[57] ABSTRACT

A device for washing clothes is formed as a large diameter tube closed at each end. It has a watertight disengageable closure between the ends, usually formed either as a cap or by unscrewing two parts of the tube and one or more intrusive portions of its wall extending into the inner space to promote turbulence when the tube is partly filled with clothes and water and then shaken. Larger sizes may be supported on two legs (or hung from a support) to facilitate shaking, and drain plates and water-removal ports can be provided.

1 Claim, 10 Drawing Figures

METHOD OF WASHING ARTICLES OF CLOTHING

This application is a continuation of application Ser. No. 634,555, filed Nov. 24, 1975, and now abandoned, which was in-turn a continuation of application Ser. No. 260,250, filed June 6, 1972, and now abandoned.

This invention relates to a method of washing articles of clothing, either in or around the home or when travelling, for example on a camping excursion.

In one aspect, the invention provides a method of washing articles of clothing in a device which consists of a tubular member, preferably of synthetic plastic material, closed at each end and provided with a watertight disengageable closure intermediate the ends, the generally tubular member having one or more intrusive regions extending into the interior thereof to promote turbulence as the tube partly filled with water is shaken.

In a particularly valuable embodiment the tubular member has rounded ends. Thus the ends may be hemispherical. Each end may be provided with a suitable handle for gripping. This handle can be longitudinally projecting or a rounded transverse handle to be gripped in clenched hands.

Generally there are a number of large corrugations extending into the interior of the tube, and for ease of manufacture it is preferred that the tube should possess corrugations visible in one longitudinal cross section but be free from corrugations in the other longitudinal cross-section, at right angles to the first. In general terms therefor, this preferred embodiment has a flattened slightly sepentine form.

While such corrugations can be regular or irregular, in one preferred form the corrugations are symmetrical about a central plane extending across the washer.

The tubular member, when partly filled with water and detergent, can be used for washing clothes by agitation along a longitudinal axis.

It is possible according to the invention to provide within the tubular member, e.g., at one or both rounded ends thereof, a transversely extending perforated plate. If desired, the plate can be removable from within the tubular member but it is preferable for at least one of the rounded ends of the tube to be detachable from the tube and for the plate to be insertable inside such rounded end.

With such perforated plate the articles can be allowed to drain into the space between the rounded end and the plate (upon hanging up the washer at the other end).

In some instances it will be found advantageous to provide a stopper in one end of the device (e.g., below the plate) so that any water draining therein can eventually be removed.

It will be observed that the internal walls of such a washer are essentially smooth and form no projections to cause damage to any clothes being washed.

The concept of providing a unitary blow molding which can be cut to provide two portions, one of which can be screwed into the other, can be applied to the provision of a plug or stopper in one curved end.

The watertight disengageable closure of this device can be formed as a cap covering a opening or as an watertight interconnection of two halves of the device. These are preferred for, but not exclusive to, a larger and a smaller version of the device, respectively, since, while the device can be made in a variety of sizes, there is advantage in making a definite smaller size for occasional washing of small articles (e.g., stockings, pantyhose drip-dry shirts, socks), and a definite larger size for a family wash and bulkier articles.

The smaller size is conveniently such as to weigh from 4 to 10 lbs when approximately half-full of water. In this form, a valuable feature is that the tubular member, when partly filled with water and detergent and used for washing clothes by agitation along a longitudinal axis, can also constitute an exercising device which provides an acceptable means of gentle daily exercise.

When such a smaller size contains a perforated plate at one or both ends, the device may be further used as an exercising implement, so that the clothes can be partly freed from water by the centrifugal effect obtained by whirling the device at arms length, holding it at the end remote from the perforated plate. In some instances it will be found advantageous to provide a stopper in one rounded end of the device (i.e., below the plate), so that any water draining therein can eventually be removed.

The tubular member may be provided in the smaller sizes as a unitary blow molding in which threads are provided at either side of an intermediate portion which is subsequently cut away, whereby the threads can be interengaged to form the tubular washing device. It is valuable under such conditions to shape the walls of the washing device internally, in such a way that, when screwed together, they are essentially smooth and form no projections to cause damage to any clothes being washed.

The larger size is conveniently from 2 to 4 feet long and from 6 to 18 inches in diameter. It may be supported on two legs which permit a rocking movement in a generally longitudinal direction, or may be supported by wire, chain or rope from, for example, the branch of a tree.

Where the ends are rounded, e.g., hemispherical, part of the hemispherical surface can be deformed to be concave (viewed from outside) to assist in promoting turbulence; where moreover a stopper is provided at one end to drain out the contained water after use it is valuable to provide a drainage duct transversing the intrusive corrugations but without detrimentally affecting the turbulence achieved by reciprocating the washer.

In this larger size there is usually provided a watertight disengageable cap over an opening intermediate the ends, preferably in the middle. Such a cap can be provided with a rim-seal arrangement (to fit over an upstanding rim around the opening) or with locking lugs cooperating with suitable lugs in the washer.

The size of the opening generally depends on the overall size of the washer. It is possible to dimension the opening so that when the washer is stood on end the amount of water retainable is the optimum amount.

The invention will be further described with reference to the accompanying drawings which show various forms of washer usable with the method according to the invention and by way of non-limiting example, and wherein.

Figure 4A:
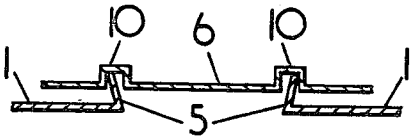
Figure 4B:
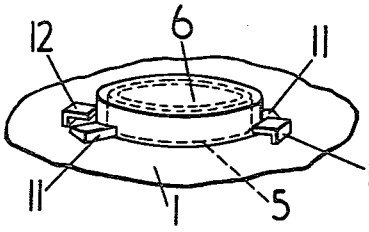
Figure 5:
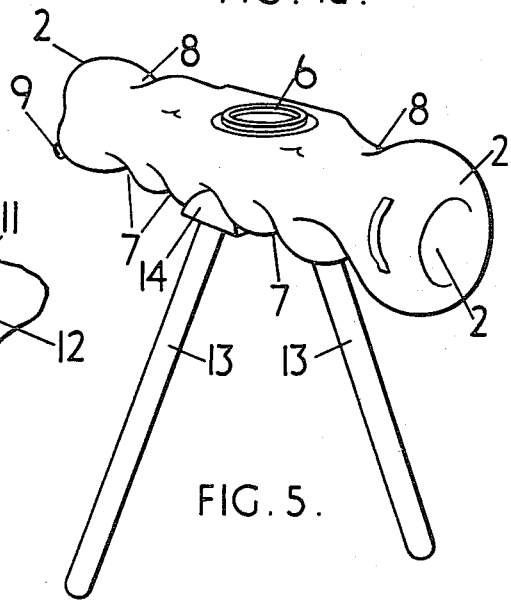
Figure 6:
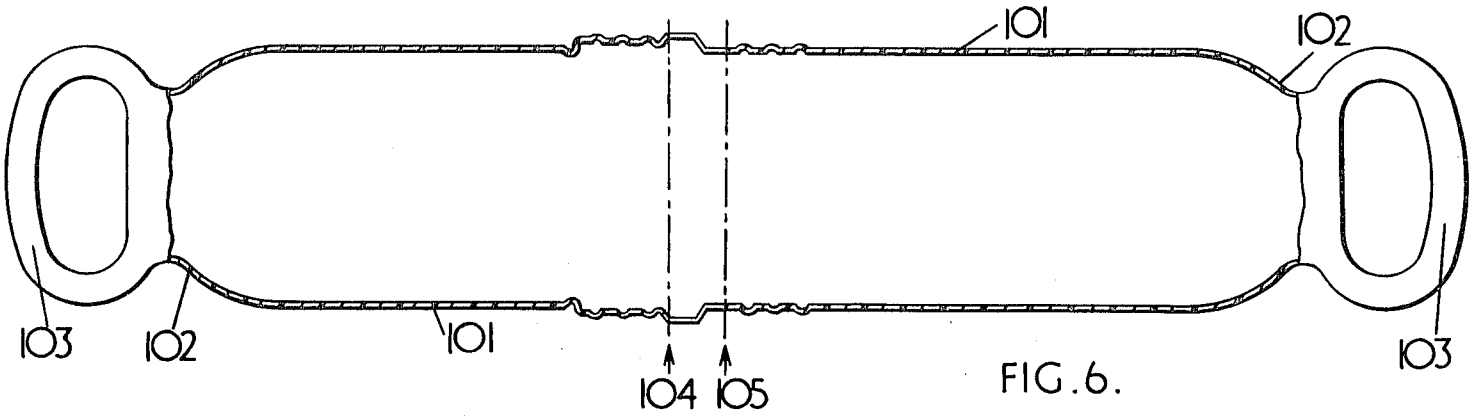
Figure 7:
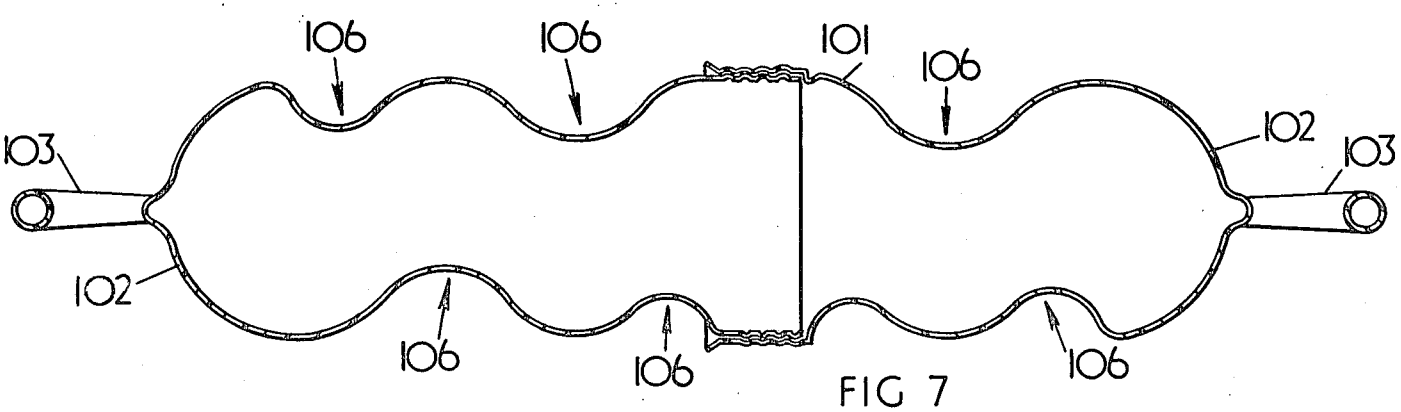
Figure 8:
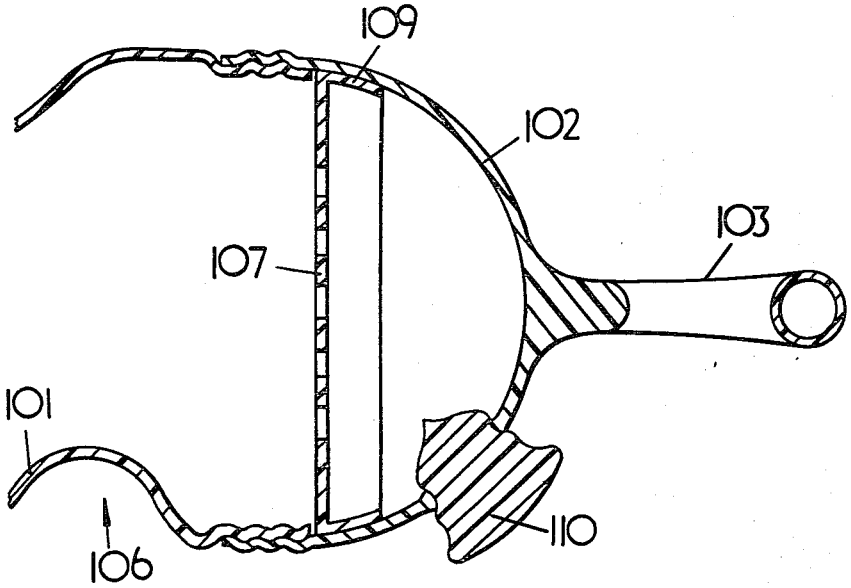
Figure 9:
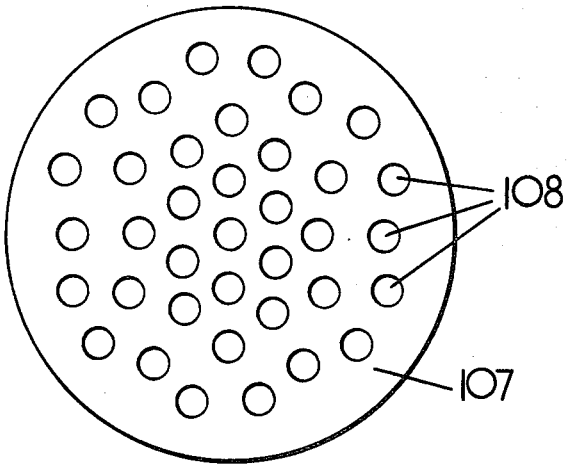

FIG. 4*a* shows one form of peripheral rim seal on the cap for the opening in such a washer, through which the water and clothes to be washed are inserted;

FIG. 4*b* shows an alternative form of sealing cap for the opening;

FIG. 5 shows a larger washer usable for the method according to the invention mounted on a two-legged stand to facilitate reciprocating movement;

FIG. 6 shows the blow molding and suitable lines whereat it can be cut apart to provide the two halves of a smaller washing usable for the method device according to the invention;

FIG. 7 shows a similar longitudinal section to FIG. 6, but at right angles to the first and showing the assembled washing device;

FIG. 8 shows one end of the washing device of FIG. 6 in a modified embodiment, including a drain plate, and FIG. 9 shows the drain plate of FIG. 8.

The washing device consists of a generally tubular body of synthetic plastic material 1 having rounded ends 2 and provided at the top with attachment eyes 3. Also at the top is an opening 4 with upstanding rim 5 over which is located a disengageable water-tight cap 6, alternative forms of which are shown in more detail below.

Along the bottom of the washer are a plurality of large corrugations 7 which cause turbulent movement of the liquid within the washer when the washer is agitated by reciprocation along a generally longitudinal axis.

Figure 1:
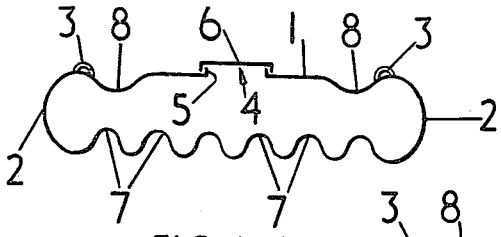
FIG. 1 shows a diagrammatic longitudinal cross-section through an embodiment of a relatively large washer usable for the method according to the present invention.
Figure 2:
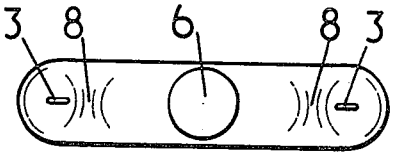
FIG. 2 shows a plan view of the washer as shown in FIG. 1.

As will be apparent from FIG. 2, it is preferred to provide further, gentler, corrugations 8 at the top of the washer to assist further in the promotion of turbulence within the equipment.

Figure 3:
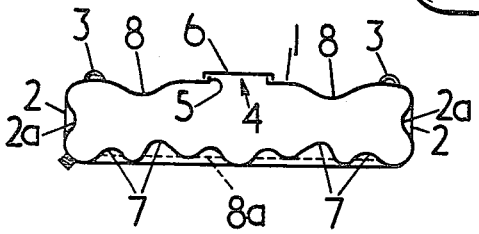
FIG. 3 shows a diagrammatic longitudinal cross section of an alternative embodiment of a larger washer usable for the method according to the present invention.

FIG. 3 shows a generally similar washer wherein the corrugations 7 are irregular but generally symmetrical about a vertical transverse plane. Moreover, the rounded ends 2 are themselves concave in the centre at 2*a* so that the turbulence produced is enhanced and the washing action is improved.

Further features shown in the embodiment of FIG. 3 include a central drainage duct 8*a* in the form of a internal channel, and a plug 9 to which the drainage duct 8*a* conveys the water so that the device can be emptied after use.

In use, the cap 6 is removed from the device and the washer placed on one end while water and clothes are filled in through the opening 4. It will be found convenient to dimension the opening 4 so that the amount of water which can be held between one end of the washer and the opening (when the washer is vertical) is the optimum amount of water for the washing process. The cap 6 is then placed on the device and the washer is vigorously agitated in a generally longitudinal direction. This can most conveniently be done by attaching it to a branch or like overhead support by rope or wire through the eyes 3. When sufficient time has been provided to wash the article, the cap is removed and the water poured out. Alternatively, and in the device shown in FIG. 3, water can be removed through the plug 9. The articles of clothing can then be removed through the opening 4.

Although not shown in the embodiments illustrated, it is possible to provide a drainage plate extending across, and spaced from one end of, the washer (for example the left hand end in FIG. 3), so that water can readily drain away through the plug opening.

The nature of the cap over the opening 4 is a subsidiary feature of the present invention. FIG. 4*a* shows a cap 6 which fits by a peripheral rim seal 10 over the upstanding rim 5 of opening 4. As will be apparent from FIG. 4*a*, the upstanding rim 5 should preferably be outwardly flared so that a good seal is obtained. Such a seal will be found convenient, but for the larger sizes in particular it may be preferable to place over the upstanding rim 5 (as shown in FIG. 4*b*) a cap 6 which is provided with diametrically opposed lugs 11 which fit under complementary lugs 12 on the washer body 1. Since the lugs 11 and 12 are suitably inclined as shown in FIG. 4*b*, a positive sealing effect will be obtained when the cap 6 is turned into place.

Of course, any other form of disengageable water-tight cap can be provided in accordance with the invention, and the details of this cap do not limit the broad scope as defined above.

FIG. 5 shows a general perspective view of a washer according to the invention (in this instance provided with a peripheral rim seal) mounted on a two-legged stand 13 by the intermediary of a rounded portion 14 which fits into one of the corrugations 7. Again, such a mounting can be used to facilitate essentially longitudinal reciprocation of the washer and thereby lead to an effective washing action.

The device for carrying out the method according to the invention in FIGS. 1 to 5 is light and portable, and forms in itself a useful container for packing other aids to washing such as soap or packets of detergent.

As will be apparent from FIG. 6, an alternative embodiment of the washing device consists of a generally tubular body 101 of synthetic plastic material having rounded ends 102 and provided at each end with handles 103. The version shown in FIG. 6 is in fact the blow-molding body prior to cutting, and it will be apparent that this body can be cut at cutting lines 104 and 105 to provide two halves which can be screwed into one another in such a way as to present an essentially smooth inner surface. An assembled washer is shown in FIG. 7 in a longitudinal section at right angles to that of FIG. 6, and it will be apparent that there are provided a plurality of large corrugations 106 which cause turbulent movement of the liquid within the washer when this is agitated by reciprocation along a longitudinal axis.

As will be apparent from FIG. 8, it is preferred to form one end of the washing device with complementary threaded portions whereby the rounded end 102 screws on to an open end of the generally tubular member 101. This rounded end 102 can be used to hold in place a plate 107 (see FIG. 9) provided with a number of perforations 108 and with inwardly curved edges or rims 109. Moreover, if desired, a plug 110 can be provided in the rounded end 102 underlying the plate. Although not shown as such, this plug 110 can itself be formed by blow-molding e.g. by forming a male and female thread in an analogous fashion to that use for the central connection of the washing device.

In use, the device of FIGS. 6 to 9 is unscrewed and partly filled with water and detergent, together with the article to be washed. The washing device is then screwed together in its central part and vigorously agitated longitudinally with a firm grip being taken on the handles at each end. It can thereby constitute an exercising device. When sufficient time has been provided to wash the article, the tubular body 101 can be unscrewed and the water poured out. Since the article will still be wet, it is recommended that it be replaced in the tube and the tube screwed together again, and that the tube be whirled at arms length with a grip being taken on the handle remote from the perforated plate 107. This exerts a centrifugal effect and water trickles through the plate into the underlying space from which it can be removed by the plug 110.

The device for carrying out the method according to the invention is light and can readily be packed into a suitcase. It again forms in itself a useful container for packing other breakable or potentially harmful materials such as cosmetics or medicines.

It will moreover be appreciated that while the device of FIGS. 6 to 9 is of generally utility in the washing of small articles, it is more particularly useful in the washing of delicate articles (such as are usually hand-washed) when, since no rotary action of action of impeller blades is involved, it does not damage such articles.

Various modifications can be made within the scope of the invention. Thus, the number and shape of the corrugations are optional provided that they are generally intrusive into the internal space of the washer and thus actively promote turbulence when the washer is moved to and fro.

I claim:

1. A method of washing articles of clothing comprising the steps of (a) providing an elongated substantially tubular member of substantially rigid construction and made of a synthetic plastic material, said member being closed at each end, and each such end having a rounded configuration, at least one end being provided with a suitable handle for gripping, and a watertight disengageable closure intermediate the ends of said member, said tubular member having a plurality of undulating regions situated along its longitudinal axis and intruding transversely into the interior thereof to a substantial extent sufficient to promote turbulence of the water and tumbling of articles of clothing when the member is partly filled with water and said articles of clothing and shaken and thereby aid in the washing of said articles of clothing in said water, said intruding regions being visible in one longitudinal cross section but not visible in the longitudinal cross section at right angles thereto, said intruding regions being located to define an essentially unconstricting internal space within the tubular member in order to facilitate general transfer of water and articles of clothing from one end thereof to the other, and a transversely extending perforated plate disposed within at least one end of the member;

(b) releasing said disengageable closure;

(c) introducing articles of clothing and water into said member;

(d) replacing said closure;

(e) vigorously agitating said clothing by shaking said member;

(f) grasping said handle;

(g) whirling said tubular member for centrifugally removing excess water from said articles of clothing such that water passes through said perforated plate and is collected within said end of the member across which said perforated plate lies; and (h) releasing said collected water and said clothing separately from said member.

* * * * *